US009847191B2

(12) United States Patent
Nakase et al.

(10) Patent No.: US 9,847,191 B2
(45) Date of Patent: Dec. 19, 2017

(54) SWITCH HAVING IMPROVED MOVEABLE CONTACT

(71) Applicant: FOXCONN INTERCONNECT TECHNOLOGY LIMITED, Grand Cayman (KY)

(72) Inventors: Yusho Nakase, Yokohama (JP); Liang Sun, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 25 days.

(21) Appl. No.: 14/840,066

(22) Filed: Aug. 31, 2015

(65) Prior Publication Data

US 2016/0064158 A1 Mar. 3, 2016

(30) Foreign Application Priority Data

Aug. 29, 2014 (CN) ..... 2014 2 0493388 U

(51) Int. Cl.
*H01H 13/14* (2006.01)
*H01H 13/48* (2006.01)

(52) U.S. Cl.
CPC ..... *H01H 13/48* (2013.01); *H01H 13/14* (2013.01); *H01H 2203/038* (2013.01); *H01H 2215/004* (2013.01); *H01H 2215/018* (2013.01); *H01H 2221/05* (2013.01); *H01H 2223/002* (2013.01); *H01H 2223/03* (2013.01); *H01H 2227/022* (2013.01)

(58) Field of Classification Search
CPC ..... H01H 13/48; H01H 2203/038; H01H 2205/016; H01H 2227/026; H01H 13/06; H01H 13/10; H01H 13/52
USPC ..... 200/406, 511–513, 516, 517
See application file for complete search history.

(56) References Cited

U.S. PATENT DOCUMENTS

2008/0014777 A1* 1/2008 Tan ..... H01H 25/008 439/164
2008/0073193 A1* 3/2008 Hu ..... H01H 13/023 200/406

FOREIGN PATENT DOCUMENTS

CN 1988088 6/2007

* cited by examiner

*Primary Examiner* — Edwin A. Leon
*Assistant Examiner* — Ahmed Saeed
(74) *Attorney, Agent, or Firm* — Wei Te Chung; Ming Chieh Chang

(57) ABSTRACT

An electrical switch (100) includes an insulative housing (110) forming a receiving space therein, a fixed contact set (121, 122) retained in the housing (110), a movable contact set (131, 132) located above the fixed contact set (121, 122), and a cover (140) mounted upon the housing, wherein the moveable contact set (131, 132) further includes at least three outwardly and downwardly extending protrusions (133) on a periphery at equal intervals so as to support up-and-down movement of the moveable contact set (131, 132) during operation with a superior manual feeling.

18 Claims, 7 Drawing Sheets

SWITCH HAVING IMPROVED MOVEABLE CONTACT

BACKGROUND OF THE INVENTION

1. Field of the Invention

The present invention relates generally to an switch, and more particularly to a switch having an improved moveable contact.

2. Description of Related Arts

The traditional switch includes an insulative housing with a receiving space therein, a fixed contact set retained in the housing, a moveable contact set located above the fixed contact, and a cover positioned upon the housing. The movable contact set includes a pair of dome-shaped contacts stacked with each other and commonly restrainedly positioned in the housing. The manual operation feels relatively dull.

A new switch having a better operation feeling is desired.

SUMMARY OF THE INVENTION

Accordingly, an object of the present invention is to provide a switch with a better operation feeling.

To achieve the above object, an electrical switch includes an insulative housing forming a receiving space therein, a fixed contact set retained in the housing, a movable contact set located above the fixed contact set, and a cover mounted upon the housing, wherein the moveable contact set further includes at least three outwardly and downwardly extending protrusions on a periphery so as to support up-and-down movement of the moveable contact set during operation with a superior feeling.

DETAILED DESCRIPTION OF THE PREFERRED EMBODIMENT

Reference will now be made in detail to the preferred embodiment of the present invention.

Figure 1:
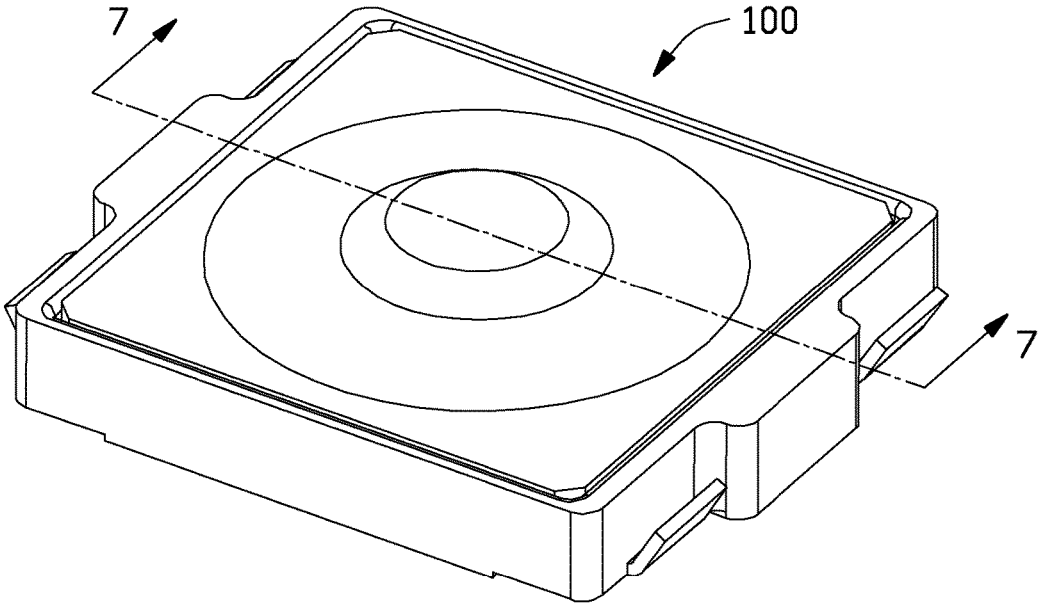
FIG. 1 is an assembled perspective view of a preferred embodiment of an electrical switch according o the invention.
Figure 2:
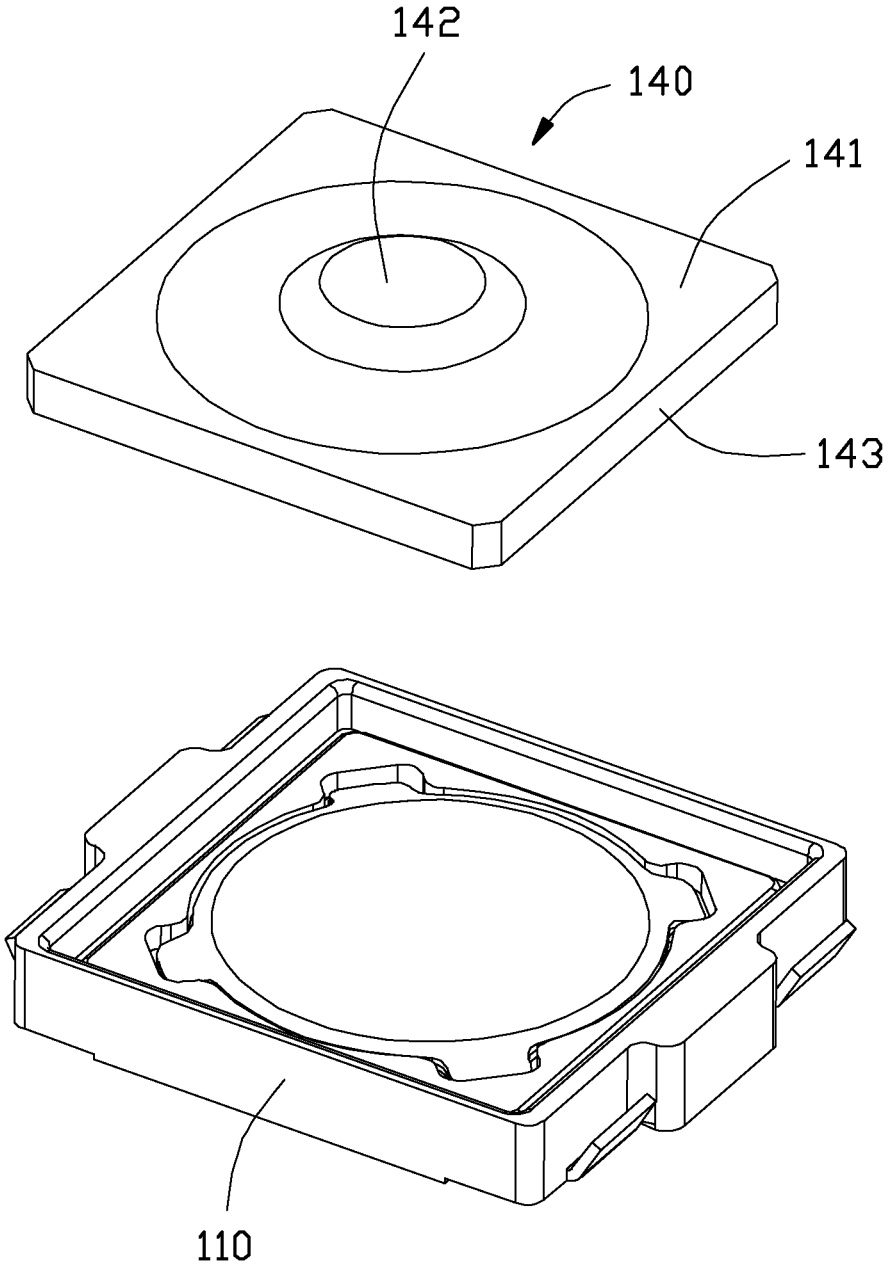
FIG. 2 is an exploded perspective view of the switch of FIG. 1.
Figure 3:
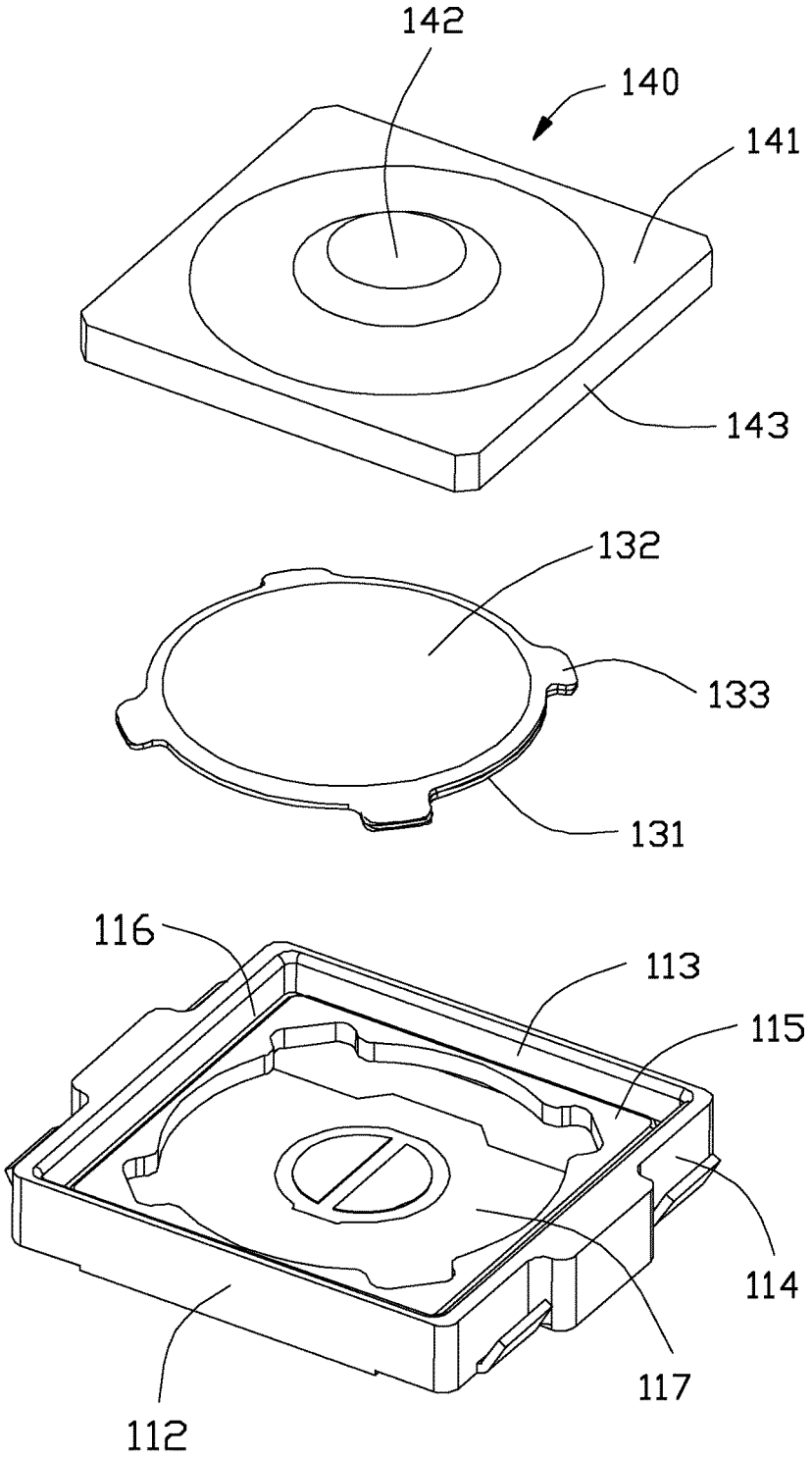
FIG. 3 is a further exploded perspective view of the switch of FIG. 2.
Figure 4:
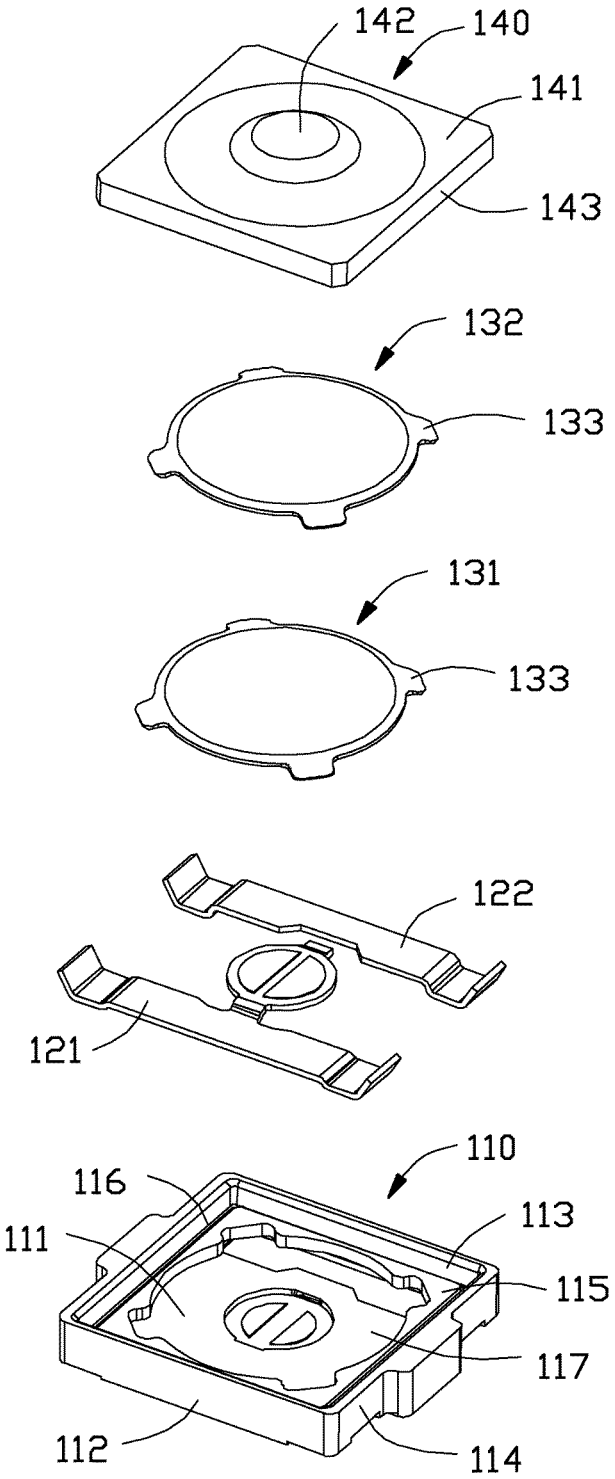
FIG. 4 is a further exploded perspective of the switch of FIG. 3.
Figure 5:
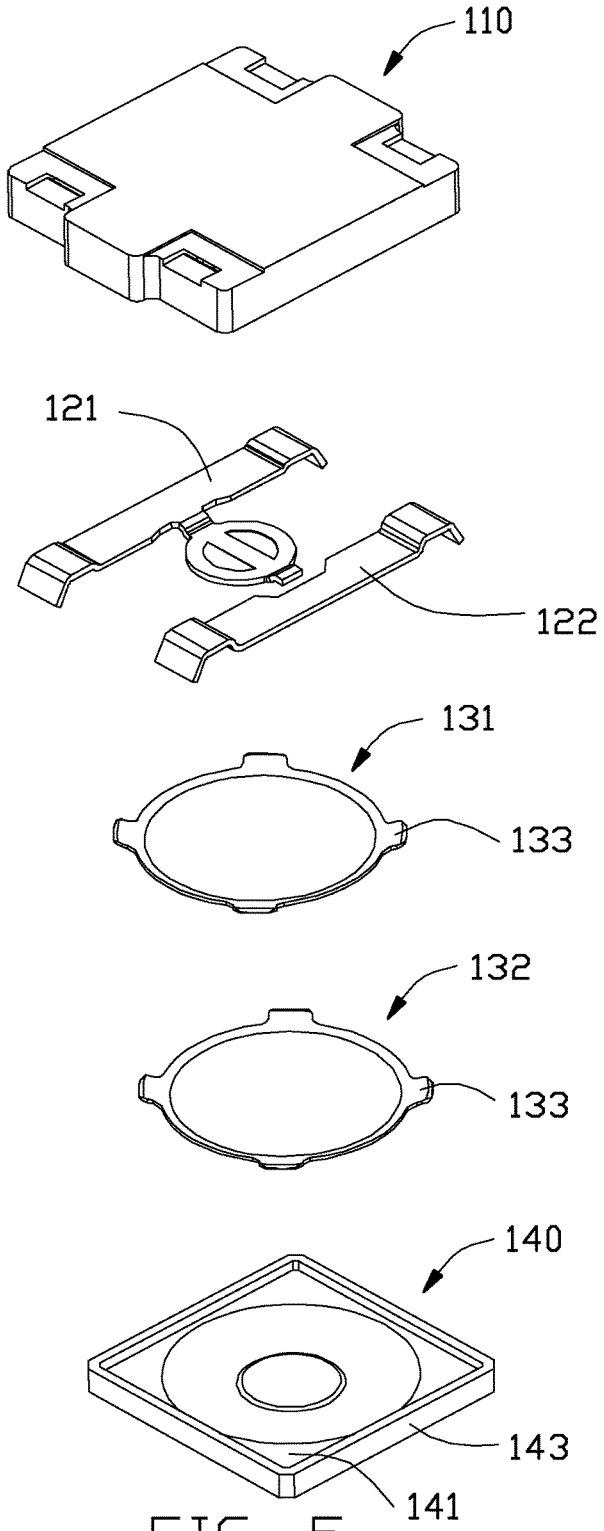
FIG. 5 is another exploded perspective view of the switch of FIG. 4.
Figure 6:
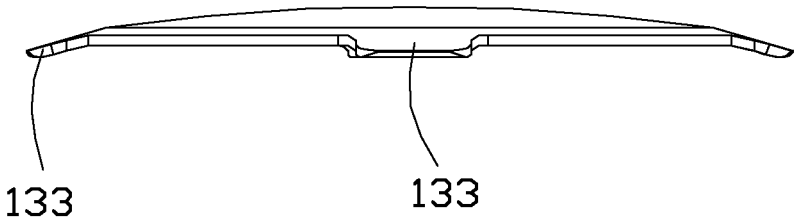
FIG. 6 is a perspective view of the moveable contact.
Figure 7:
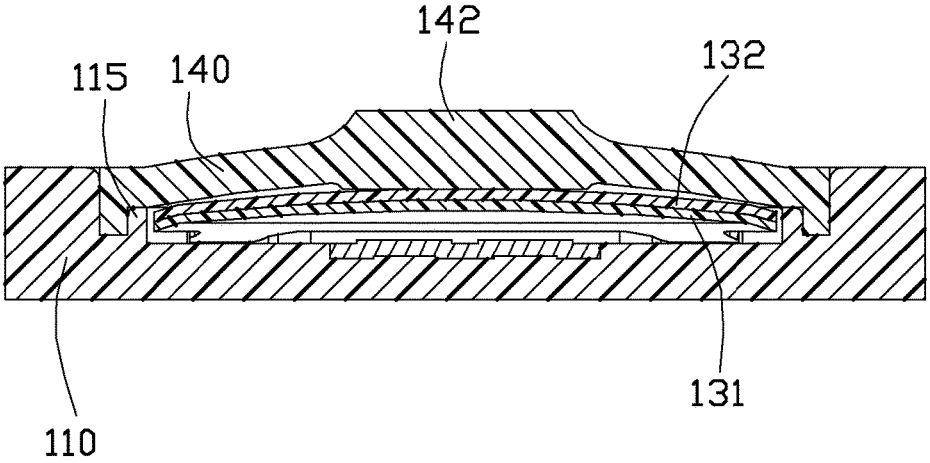
FIG. 7 is a cross-sectional view of the switch of FIG. 1

Referring to FIGS. 1-7, an electrical switch 100 includes an insulative housing 110 forming a receiving space (illustrated later), a fixed contact set (illustrated later) retained in the housing 110, a moveable contact set (illustrated later) located above the fixed contact set, and an insulative cover 140 mounted to the housing 110.

The housing 110 having includes a bottom wall 111 and four side walls composed of opposite front wall 112 and rear wall 113 and opposite two side walls 114 linking said opposite front wall 112 and rear wall 113. The aforementioned receiving space is formed by the bottom wall 111, the opposite front wall 112 and rear wall 113, and the opposite two side walls 114. The housing 110 further includes the platform 115 raised up from the bottom wall 111 so as to divide the receiving space into the first/upper receiving space 116 and the second/lower receiving space 117.

The fixed contact set includes a first fixed contact 121 and the second fixed contact 122, of which both are integrally formed with the bottom wall 111 via an insert-molding process. The first fixed contact 121 and the second fixed contact 122 have soldering section exposed upon the bottom surface of the housing for mounting to a printed circuit board. The moveable contact set up and down moveable between opposite upper and lower positions, include a first moveable contact 131 and a second moveable contact 132 stacked with each other and commonly received within the second receiving space 117. Both the first moveable contact 131 and the second moveable contact 132 are of a dome shape around a central region, and each includes further four outwardly and downwardly extending protrusions 133 arranged along a periphery at equal intervals and laterally confront the platform 115. In an unused condition, corresponding abutment periphery edges (not labeled) of two of the protrusions 133 constantly mechanically and electrically connect to the second fixed contact 122 while the whole moveable contact set is spaced from the first fixed contact 121; in a used condition in which the moveable contact set is downwardly pressed, the central region of the moveable contact set downwardly electrically and mechanically connects the circular region (not labeled) of the first fixed contact 121 so as to electrically connect the first fixed contact 121 and the second fixed contact 122.

The cover 140 made from elastic material for deformation, includes a top plate 141, a protruding button 142 in the central region, and four side walls 143 downwardly extending from four side edges of the top plate 141 and into the corresponding grooves (not labeled) between the platform 115 and the corresponding four side walls of the housing 110 wherein the cover 140 is essentially received within the first receiving space 116.

The second receiving space 117 forms a contour in compliance with that of the moveable contact set, including a central circular portion to receive the corresponding dome shape and four outwardly extending portions along four different radial directions which are essentially directed to opposite corners of the housing 110 to receive the corresponding protrusions 133, respectively. Understandably, in the traditional switch, the dome-shaped moveable contact set is essentially supported via the whole periphery thereof during up-and-down operation so as to result in compression/deformation circumferentially in a relative dull manner. Differently, in the instant invention, only via the four spaced downwardly and outwardly extending protrusions 133 supporting instead of the whole peripheral support, the whole moveable contact set is deformed and compressed in a delicate manner with a better and clear operation feeling wherein due to the four protrusions 133 retained in the corresponding outwardly extending portion of the second receiving space 117, no rotation of the moveable contact set in the second receiving space 117 will occur. Thus, a reliable click operation is achieved. Notably, instead of using the protrusions 133, alternately the anti-rotation function may be performed by forming a plurality of notches in the periphery of the central region of the moveable contact set, and the housing 110 forms a plurality of dimples engaged within the corresponding notches, respectively. Moreover, because the moveable contact set is supported via only the protrusions 133, there should be at least three protrusions at equal intervals for stable support during deformation of the moveable contact set.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical switch comprising:

an insulative housing defining an upper receiving space and a lower receiving space;

a fixed contact set retained in the housing and including a first fixed contact and a second fixed contact spaced from each other; and a movable contact set received within the lower receiving space, located above the fixed contact set and moveable up and down between opposite upper and lower positions, and defining a dome shape with at least three downwardly and outwardly extending protrusions spaced, with equal intervals, from one another on a periphery surrounding a central region for supporting the movable contact set; wherein the moveable contact set is constantly mechanically and electrically connected to the second fixed contact via an abutment edge of at least one of said extending protrusions but is electrically disconnected from the first fixed contact when said moveable contact set is located at the upper position, and mechanically and electrically connected to the first fixed contact via said central region when the moveable contact set is located at the lower position; wherein the insulative housing including a bottom wall, four side walls to commonly for a receiving space, and a platform raised up from the bottom wall so as to divide said receiving space into the upper receiving space and the lower receiving space, an upper surface of the side walls extending upwardly beyond the platform.

2. The electrical switch as claimed in claim 1, further including a cover mounted in the upper receiving space with a button portion located above the central region of the moveable contact set for downward actuating said central region.

3. The electrical switch as claimed in claim 1, wherein each of said protrusions extends in a radial direction.

4. The electrical switch as claimed in claim 1, wherein said lower receiving space includes a central circular portion to receive the central region of the moveable contact set, and a plurality of outwardly extending portion on a periphery of the central circular portion to receive the corresponding extending protrusions, respectively.

5. The electrical switch as claimed in claim 4, wherein said housing forms a plurality of corners, and said protrusions are directed to said corners, respectively.

6. The electrical switch as claimed in claim 1, wherein the housing further form a platform on which said upper receiving space is located.

7. The electrical switch as claimed in claim 6, wherein a plurality of grooves are formed between the platform and side walls of the housing to receive corresponding side wall of a cover mounted in the upper receiving space.

8. The electrical switch as claimed in claim 1, wherein said moveable contact set has support only via said extending protrusion during downward depression instead of the periphery.

9. An electrical switch comprising:

an insulative housing defining a receiving space having a central circular portion and a plurality of outwardly extending portions spaced from each other each extending in a radial direction;

a fixed contact set retained in the housing and including a first fixed contact and the second fixed contact;

a moveable contact set up and down moveable between opposite upper and lower positions, disposed in the receiving space and forming a dome shaped central region conformably received in the central circular portion, and at least two outwardly and downwardly extending protrusions conformably formed on a periphery of said central region and received in the outwardly extending portions, respectively, for supporting the moveable contact set; wherein an abutment edge of at least one of the extending protrusions constantly mechanically and electrically connect to the second fixed contact, and the central region of the moveable contact set selectively is spaced and mechanically and electrically disconnected from the first fixed contact when in the upper position while is mechanically and electrically connected to the first fixed contact when in the lower position; wherein the insulative housing including a bottom wall, four side walls and a platform raised up from the bottom wall to divide said receiving space into an upper receiving space and a lower receiving space, an upper surface of the side walls extending upwardly beyond the platform, said moveable contact being received in said lower receiving space.

10. The electrical switch as claimed in claim 9, wherein the moveable contact set is supported via only said extending protrusions during downward deformation.

11. The electrical switch as claimed in claim 9, wherein said first fixed contact includes a circular region located under the central region of the moveable contact.

12. The electrical switch as claimed in claim 9, wherein said moveable contact includes an upper moveable contact and a lower moveable contact stacked.

13. The electrical switch as claimed in claim 12, wherein both said upper moveable contact and said lower moveable contact have a same configuration.

14. The electrical switch as claimed in claim 9, further including a cover mounted upon the housing to shield the moveable contact set.

15. The electrical switch as claimed in claim 9, wherein said moveable contact set is received within the receiving space without rotation due to engagement of the extending protrusion in the outwardly extending portions.

16. The electrical switch as claimed in claim 9, wherein said housing forms a plurality of corners and said protrusions are directed to the corresponding corners, respectively.

17. The electrical switch as claimed in claim 1, wherein said abutment edge is located on a periphery of said at least one of said extending protrusions.

18. The electrical switch as claimed in claim 9, wherein said abutment edge is located on a periphery of said at least one of said extending protrusions.

* * * * *